US008573419B2

(12) United States Patent
Kaiser et al.

(10) Patent No.: US 8,573,419 B2
(45) Date of Patent: Nov. 5, 2013

(54) SWING DRIVE SYSTEM FOR CRANES

(75) Inventors: Joseph R. Kaiser, Cottage Grove, MN (US); Alan E. Pleuss, Manitowoc, WI (US); Andrew L. Langer, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 433 days.

(21) Appl. No.: 12/710,960

(22) Filed: Feb. 23, 2010

(65) Prior Publication Data

US 2010/0213153 A1 Aug. 26, 2010

Related U.S. Application Data

(60) Provisional application No. 61/155,414, filed on Feb. 25, 2009.

(51) Int. Cl.
*B66C 23/86* (2006.01)

(52) U.S. Cl.
USPC ..... 212/247; 212/245; 212/253

(58) Field of Classification Search
CPC ..... B66C 23/84; B66C 23/86
USPC ..... 212/245, 247, 248, 218, 253; 74/89.19
See application file for complete search history.

(56) References Cited

U.S. PATENT DOCUMENTS

| | | | | |
|---|---|---|---|---|
| 3,461,735 | A * | 8/1969 | Francois | 74/410 |
| 3,807,250 | A * | 4/1974 | Dietzel et al. | 74/410 |
| 3,949,881 | A * | 4/1976 | Morrow et al. | 212/247 |
| 3,954,020 | A | 5/1976 | West et al. | |
| 4,013,174 | A * | 3/1977 | Morrow et al. | 212/288 |
| 5,746,148 | A * | 5/1998 | Delago | 114/230.12 |
| 6,035,736 | A * | 3/2000 | Gyllner et al. | 74/397 |
| 7,891,508 | B2 * | 2/2011 | Delago | 212/253 |
| 2002/0057961 | A1 * | 5/2002 | Brown et al. | 414/694 |
| 2004/0164040 | A1 * | 8/2004 | Delago | 212/253 |

FOREIGN PATENT DOCUMENTS

WO WO 2008/074320 A1 6/2008

OTHER PUBLICATIONS

Four photographs of scale model of Model 31000 crane displayed at ConExpo show, Las Vegas, Nevada, Mar. 2008.
Four snapshots from video of Model 31000 crane shown at ConExpo show, Las Vegas, Nevada, Mar. 2008.
Brochure from confidential Manitowoc "Model 31000 Provisional Product Guide" 26 pages, dated May 23, 2008.
Drawings of Front Roller Carrier Assembly M1200R, dated prior to Feb. 25, 2008 (2 pages redacted).
Manitowoc, "36-Foot Diameter Platform-Ringer—Specifications," 6 pages (1977).

* cited by examiner

*Primary Examiner* — William E Dondero
*Assistant Examiner* — Nathaniel Adams
(74) *Attorney, Agent, or Firm* — Steven P. Shurtz; Brinks Hofer Gilson & Lione

(57) ABSTRACT

A crane includes i) a lower structure comprising ground engaging members ii) an upper structure rotatably connected to the lower structure such that the upper structure can swing with respect to the lower structure, wherein one of the lower structure and upper structure comprises a first structure having a ring gear having teeth on a surface thereof, and the other of the lower structure and upper structure comprises a second structure; and iii) a boom pivotally mounted on the upper structure. The crane further includes a drive system comprising at least two pinion gears mounted on a common frame and in driving contact with the ring gear teeth; and a link connecting the frame to the second structure with two pivot axes between the frame and the second structure.

22 Claims, 9 Drawing Sheets

SWING DRIVE SYSTEM FOR CRANES

REFERENCE TO EARLIER FILED APPLICATIONS

The present application claims the benefit of the filing date under 35 U.S.C. §119(e) of Provisional U.S. Patent Application Ser. No. 61/155,414, filed on Feb. 25, 2009, which is hereby incorporated by reference in its entirety.

BACKGROUND

The present invention relates to a swing drive system for cranes, particularly useful on mobile lifting cranes.

A typical crane includes a lower structure that is supported on ground engaging members, an upper structure rotatably connected to the lower structure such that the upper structure can swing with respect to the lower structure about a vertical axis, and a boom pivotally mounted on the upper structure. To produce swing torque, a swing drive system exerts a moment between the upper and lower structures. This is usually accomplished by mounting a drive gear, commonly known as a pinion gear, offset from the centerline of rotation, to produce the moment. Either the lower structure or the upper structure will usually have a ring gear having teeth on a surface thereof, and the other structure will include the pinion gear that meshes with the teeth on the ring gear to provide the swing torque. If the crane is positioned such that the axis of rotation is not completely vertical (such as a mobile lift crane positioned on sloped ground), the swing drive system also has to provide a holding force to keep the upper structure from rotating when rotation is not wanted and the center of gravity of the combined crane and any load attached thereto is not at the "bottom" of its swing path.

Mobile lift cranes typically include a carbody having moveable ground engaging members, such as tires or crawlers; a rotating bed rotatably connected to the carbody such that the rotating bed can swing with respect to the ground engaging members; a boom pivotally mounted on a front portion of the rotating bed, with a load hoist line extending there from; and counterweight to help balance the crane when the crane lifts a load. Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner.

For some very large cranes, the torque needed to swing the crane is very large, particularly when a large load is suspended from the load hoist line. Thus the size of the ring gear and its teeth, and the size of the pinion gear, must be large enough to generate the required torque at a reasonable size ring gear diameter. In large cranes it is typical to include multiple pinion gears that each mesh with the same ring gear, so as to be able to generate the required force. However, utilizing multiple pinion gears complicates features of the crane design, particularly when it is recognized that the ring gear and pinion gear need to mesh with a tight tolerance, taking into account the needed "backlash" in the drive system. Backlash is a term that describes the amount of free play that exists between the gear teeth—the amount that one gear can turn before it starts to turn the other gear. If there is not enough backlash, the gear teeth will wear out too fast, as there will be unnecessary contact between parts of the teeth. If the backlash is too large, there will be high impact forces on the teeth when the rotating bed starts to swing, or changes its direction of swing.

Since the ring gear is not perfectly round, and since the structure making up the rotating bed (especially if it has multiple pieces that are transported separately and then pinned together at a job site) may have tolerances associated with the connection between the rotating bed and the carbody, and tolerances in the swing drive system, getting multiple pinion gears so that they can all provide torque simultaneously and with a proper amount of backlash is problematic. Of course if all of the pinion gears could be mounted to the rotating bed so that their points of contact with the ring gear formed a perfect circle, the same diameter as the ring gear, that would help lessen the problem, but this design criteria makes manufacture of the crane very expensive. The problem increases with a greater number of pinion gears. One solution is to have a thick ring gear, so that the engaged length of each gear tooth is higher, and thus more force can be transmitted through each tooth. While cutting down on the number of pinion gears, this solution increases the weight of the ring gear.

One solution is to have multiple pinion gears all connected to the rotating bed in a manner that they are independently forced into contact with the ring gear by a structure that is pivotally mounted to the rotating bed. This makes it simple to accommodate for tolerances and free play in the connection between the rotating bed and the carbody, and tolerances in the swing drive system. However, it makes for a large number of independent components that have to be disassembled, stored, transported and reassembled each time the crane is moved. Thus it would be a great advantage if a drive system could be developed that allowed such very large cranes to utilize multiple pinion gears without needing precision in the mounting of the pinion gears and minimizing the number of independent components that have to be transported and assembled to construct the crane.

BRIEF SUMMARY

The present invention includes a crane that has drive system wherein multiple pinion gears are used to cut down on the required thickness of the ring gear, but the pinion gears are mounted in a manner in which precision is not needed in the attachment of the pinion gears to the crane component to which they are attached, and multiple pinion gears are mounted in a common frame, thereby reducing the number of separate components that have to be transported and assembled to construct the crane.

In a first aspect, the invention is a crane comprising i) a lower structure comprising ground engaging members; ii) an upper structure rotatably connected to the lower structure such that the upper structure can swing with respect to the lower structure, wherein one of the lower structure and upper structure comprises a first structure having a ring gear having teeth on a surface thereof, and the other of the lower structure and upper structure comprises a second structure; and iii) a boom pivotally mounted on the upper structure, the crane including a drive system comprising: at least two pinion gears mounted on a common frame and in driving contact with the ring gear teeth; and a link connecting the frame to the second structure with two pivot axes between the frame and the second structure.

In a second aspect, the invention is a mobile lift crane comprising: a) a carbody having moveable ground engaging members; b) a rotating bed rotatably connected to the carbody such that the rotating bed can swing with respect to the ground engaging members; c) a boom pivotally mounted on the rotating bed; d) one of the carbody and rotating bed comprising a first structure and the other of the carbody and rotating bed comprising a second structure; e) a ring gear having teeth on a surface thereof mounted on the first structure; f) a plurality of pinion gears mounted on the second structure in driving engagement with the ring gear; g) at least two of the pinion gears being mounted on a common frame; and h) a link connecting the frame to the second structure with two pivot axes between the frame and the second structure.

By mounting two pinion gears in a common frame with the pivoting link of the present invention, the pinion gears can be held in appropriate contact with the ring gear with the appropriate amount of backlash without requiring a great deal of precision in the mounting of the pinion gears to the rotating bed, and without a great deal of precision in the rest of the swing drive structure. These and other advantages of the invention, as well as the invention itself, will be more easily understood in view of the attached drawings.

DETAILED DESCRIPTION OF THE DRAWINGS AND THE PRESENTLY PREFERRED EMBODIMENTS

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present invention relates to a high capacity mobile lift crane, other aspects of which are disclosed in U.S. Pat. No. 7,546,928 and the following co-pending United States patent applications assigned to the assignee of the present application: "Mobile Lift Crane With Variable Position Counterweight," Ser. No. 12/023,902, filed Jan. 31, 2008, "Mast Raising Structure And Process For High-Capacity Mobile Lift Crane," Ser. No. 11/740,726, filed Apr. 26, 2007, "Connection System For Crane Boom Segments," Ser. No. 12/273,310, filed Nov. 18, 2008, "Drive Tumbler And Track Drive For Mobile Vehicles, Including Lift Cranes," Ser. No. 12/368,143, filed Feb. 9, 2009, "Track Connection System For Mobile Vehicles, Including Lift Cranes," Ser. No. 12/368,125, filed Feb. 9, 2009, "Track Tensioning System For Mobile Vehicles, Including Lift Cranes," Ser. No. 12/368,113, filed Feb. 9, 2009, "Boom Hoist Transportation System And Crane Using Same," Ser. No. 12/561,007, filed Sep. 16, 2009, Carbody Connection System And Crane Using Same," Ser. No. 12/561,103, filed Sep. 16, 2009, "Trunnion Transportation System And Crane Using Same," Ser. No. 12/561,058, filed Sep. 16, 2009, "Drum Frame System For Cranes," Ser. No. 12/561,094, filed Sep. 16, 2009, "Crane Hook Block," Ser. No. 61/155,455, filed Feb. 25, 2009, "Counterweight Block And Assemblies For Cranes," Ser. No. 61/158,599, filed Mar. 9, 2009, "Folding Jib Main Strut And Transportable Reeved Strut Caps," Ser. No. 61/165,403, filed Mar. 31, 2009, "Crane Boom Stop," Ser. No. 61/179,935, filed May 20, 2009, and "Crane Backstay Spreader," Ser. No. 61/179,983, filed May 20, 2009. Each of these applications is hereby incorporated by reference.

Several terms used in the specification and claims have a meaning defined as follows.

The term "ground engaging member" designates a structure that supports the lower works of a crane. In a mobile lift crane, the ground engaging members are typically crawlers with tracks, or tires. Other cranes may be mounted on pedestal or other fixed structure, in which case the ground engaging members are the portions of the fixed structure secured to the ground. On a barge mounted crane, the sections of the crane securing the crane to the barge are considered ground engaging members for the present invention.

Figure 1:
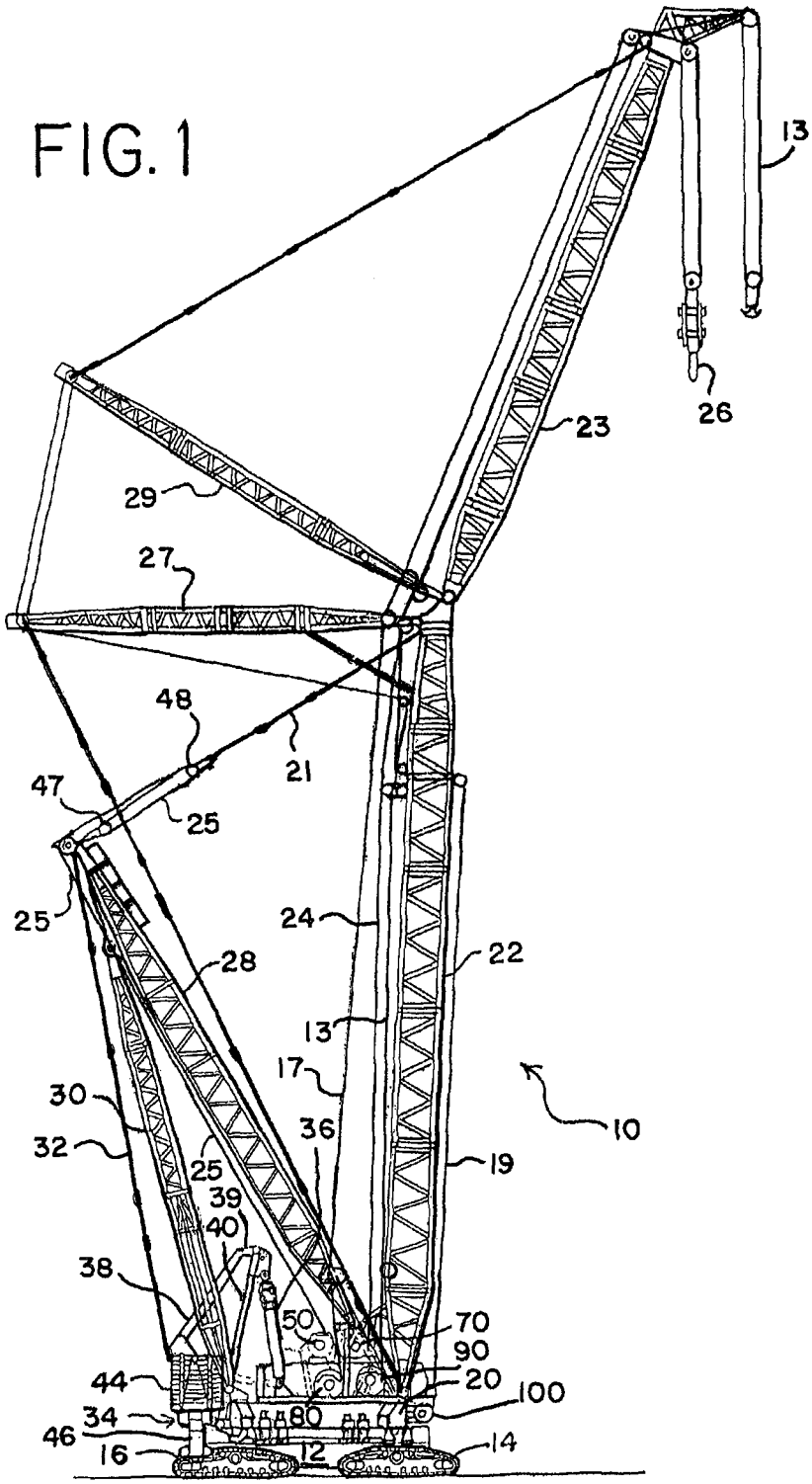
FIG. 1 is a side elevational view of a preferred embodiment of a mobile lift crane utilizing the swing drive system of the present invention.

While the invention will have applicability to many types of cranes, it will be described in connection with mobile lift crane 10, shown in an operational configuration in FIG. 1. The mobile lift crane 10 includes a lower structure, also referred to as a carbody 12, and moveable ground engaging members in the form of crawlers 14 and 16. There are of course two front crawlers 14 and two rear crawlers 16, only one each of which can be seen from the side view of FIG. 1. In the crane 10, the ground engaging members could be just one set of crawlers, one crawler on each side. Of course additional crawlers than those shown can be used, as well as other types of ground engaging members, such as tires.

A rotating bed 20 is part of the upper structure of the crane 10 and is rotatably connected to the carbody 12 such that the rotating bed can swing with respect to the ground engaging members. One of the lower structure and upper structure comprise a first structure having a ring gear having teeth on a surface thereof, and the other of the lower structure and upper structure comprises a second structure to which the drive system of the present invention is attached. In the crane 10 the rotating bed is mounted to the carbody 12 with a slewing ring that includes the ring gear, such that the rotating bed 20 can swing about an axis with respect to the ground engaging members 14, 16. The rotating bed supports a boom 22 pivotally mounted on a front portion of the rotating bed; a mast 28 mounted at its first end on the rotating bed; a backhitch 30 connected between the mast and a rear portion of the rotating bed; and a moveable counterweight unit 34. The counterweight may be in the form of multiple stacks of individual counterweight members 44 on a support member.

Boom hoist rigging (described in more detail below) between the top of mast 28 and boom 22 is used to control the boom angle and transfer load so that the counterweight can be used to balance a load lifted by the crane. A load hoist line 24 is trained over a pulley on the boom 22, supporting a hook 26. At the other end, the load hoist line is wound on a first main load hoist drum 70 connected to the rotating bed. The rotating bed 20 includes other elements commonly found on a mobile lift crane, such as an operator's cab, hoist drum 50 for the boom hoist rigging, a second main hoist drum 80 and an auxiliary load hoist drum 90 for a whip line. If desired, and as shown in FIG. 1, the boom 22 may comprise a luffing jib 23 pivotally mounted to the top of the main boom, or other boom configurations. When a luffing jib 23 is included, the crane may include first and second jib struts 27 and 29, as well as associated luffing jib rigging and a luffing jib hoist drum 100, which in the embodiment depicted is mounted on the front roller carrier of the rotating bed 20. Luffing jib hoist line 19 runs from drum 100 up to the rigging that controls the angle between jib struts 27 and 29.

The backhitch 30 is connected adjacent the top of the mast 28, but down the mast far enough that it does not interfere with other items connected to the mast. The backhitch 30 may comprise a lattice member, as shown in FIG. 1, designed to carry both compression and tension loads. In the crane 10, the mast is held at a fixed angle with respect to the rotating bed during crane operations, such as a pick, move and set operation.

The counterweight unit 34 is moveable with respect to the rest of the rotating bed 20. A tension member 32 connected adjacent the top of the mast supports the counterweight unit in a suspended mode. A counterweight movement structure is connected between the rotating bed and the counterweight unit such that the counterweight unit may be moved to and held at a first position in front of the top of the mast, and moved to and held at a second position rearward of the top of the mast, described more fully in U.S. patent application Ser. No. 12/023,902.

At least one linear actuation device 36, such as a hydraulic cylinder, or alternatively a rack and pinion assembly, and at least one arm pivotally connected at a first end to the rotating bed and at a second end to the a linear actuation device 36, are used in the counterweight movement structure of crane 10 to change the position of the counterweight. The arm and linear actuation device 36 are connected between the rotating bed and the counterweight unit such that extension and retraction of the linear actuation device 36 changes the position of the counterweight unit compared to the rotating bed. While FIG. 1 shows the counterweight unit in its most forward position, the linear actuation device 36 can be partially or fully extended, which moves the counterweight unit to mid and aft positions, or any intermediate position, such as when a load is suspended from the hook 26.

In the preferred embodiment of the counterweight movement structure, a pivot frame 40, which may be a solid welded plate structure, is connected between the rotating bed 20 and the second end of the linear actuation device 36. The rear arm 38 is connected between the pivot frame 40 and the counterweight unit. The rear arm 38 is also a welded plate structure with an angled portion 39 at the end that connects to the pivot frame 40. This allows the arm 38 to connect directly in line with the pivot frame 40. The backhitch 30 has an A-shape configuration, with spread apart lower legs, which allows the counterweight movement structure to pass between the legs when needed.

The crane 10 may be equipped with a counterweight support system 46, which may be required to comply with crane regulations in some countries. The counterweight movement structure and counterweight support structure are more fully disclosed in U.S. patent application Ser. No. 12/023,902.

Figure 2:
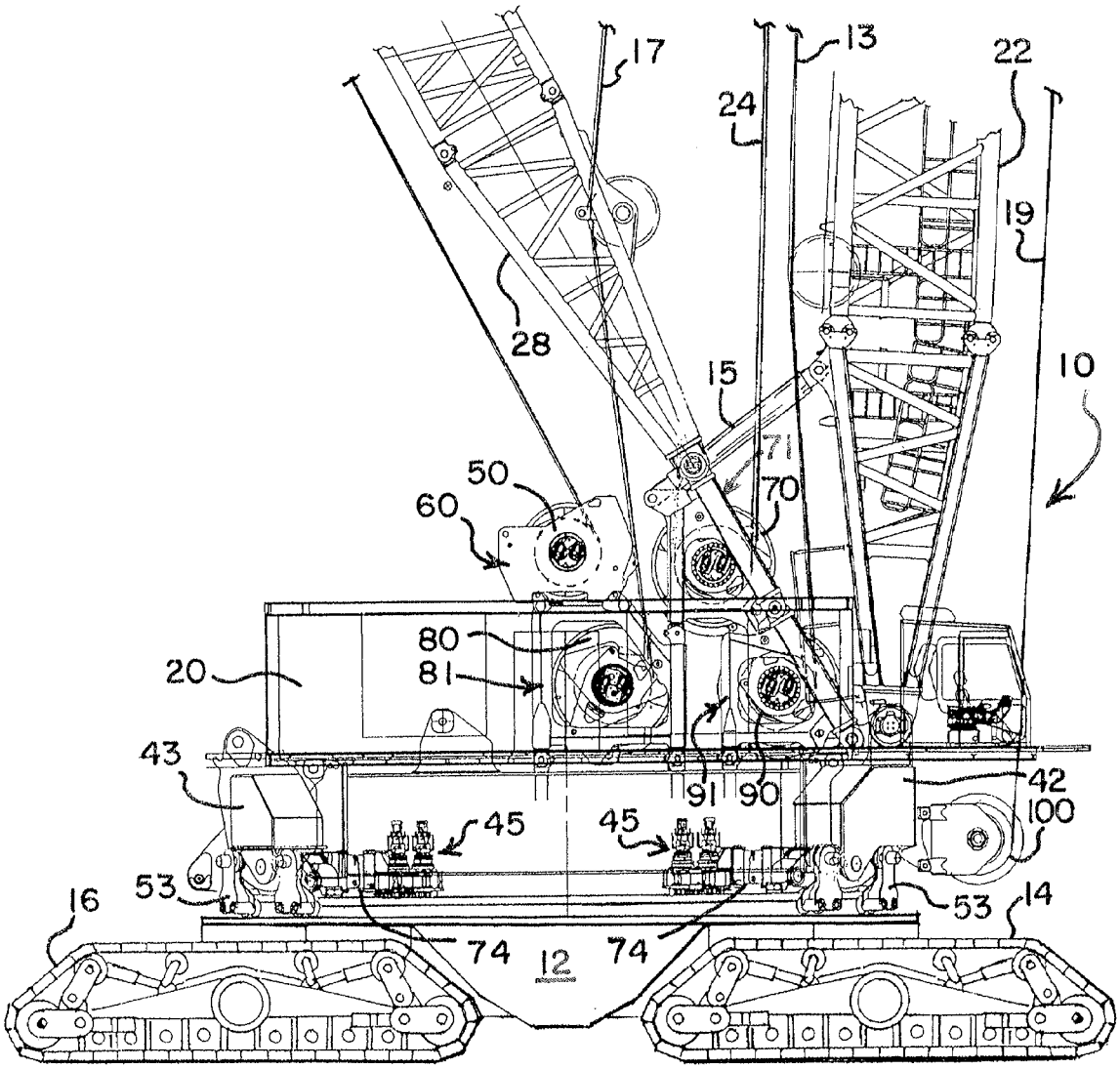
FIG. 2 is an enlarged side elevational view of the crane of FIG. 1 with some of the components removed for sake of clarity.

The boom hoist rigging includes a boom hoist line in the form of wire rope 25 wound on a boom hoist drum 50, and reeved through sheaves on a lower equalizer 47 and an upper equalizer 48. The boom hoist drum is mounted in a frame 60 (FIG. 2) connected to the rotating bed. The rigging also includes fixed length pendants 21 connected between the boom top and the upper equalizer 48. The lower equalizer 47 is connected to the rotating bed 20 though the mast 28. This arrangement allows rotation of the boom hoist drum 50 to change the amount of boom hoist line 25 between the lower equalizer 47 and the upper equalizer 48, thereby changing the angle between the rotating bed 20 and the boom 22.

The boom hoist drum frame 60, the lower equalizer 47 and the upper equalizer 48 each include cooperating attachment structures whereby the lower and upper equalizers can be detachably connected to the boom hoist drum frame so that the boom hoist drum, the lower equalizer, the upper equalizer and the boom hoist line can be transported as a combined assembly. The combined boom hoist drum 50, frame 60, lower equalizer 47 and upper equalizer 48, arranged as they would be for transportation between job sites, are described in U.S. patent application Ser. No. 12/561,007.

Crane 10 includes four drums each mounted in a frame and connected to the rotating bed in a stacked configuration, as well as a fifth drum mounted in a frame attached to the front roller carrier. Frames of two of the four stacked drums are connected directly to the rotating bed, while the frames of the other two drums are indirectly connected to the rotating bed by being directly connected to at least one of the two drum frames connected directly to the rotating bed. In this case, the four stacked drums are preferably the first main load hoist drum 70 with load hoist line 24 wound thereon, the second main load hoist drum 80 with load hoist line 17 wound thereon, the auxiliary load hoist drum 90 with whip line 13 wound thereon, and the boom hoist drum 50 with boom hoist line 25 wound thereon. Preferably the frame 91 of the auxiliary load hoist drum 90 and frame 81 of the second main load hoist drum 80 are connected directly to the rotating bed, the frame 71 of the first main load hoist drum 70 is connected to both of frames 81 and 91, while the frame 60 for the boom hoist drum 50 is connected to frame 81. In that regard, the boom hoist drum frame 50 is thus stacked on top of and pinned directly to the second main load hoist drum frame 81, and the first main load hoist drum frame 71 is stacked on top of and pinned directly to the auxiliary load hoist drum frame 91. In the crane 10, both the mast 28 and a boom stop 15 are attached indirectly to the rotating bed 20 through a connection to the frame 71.

Figure 3:
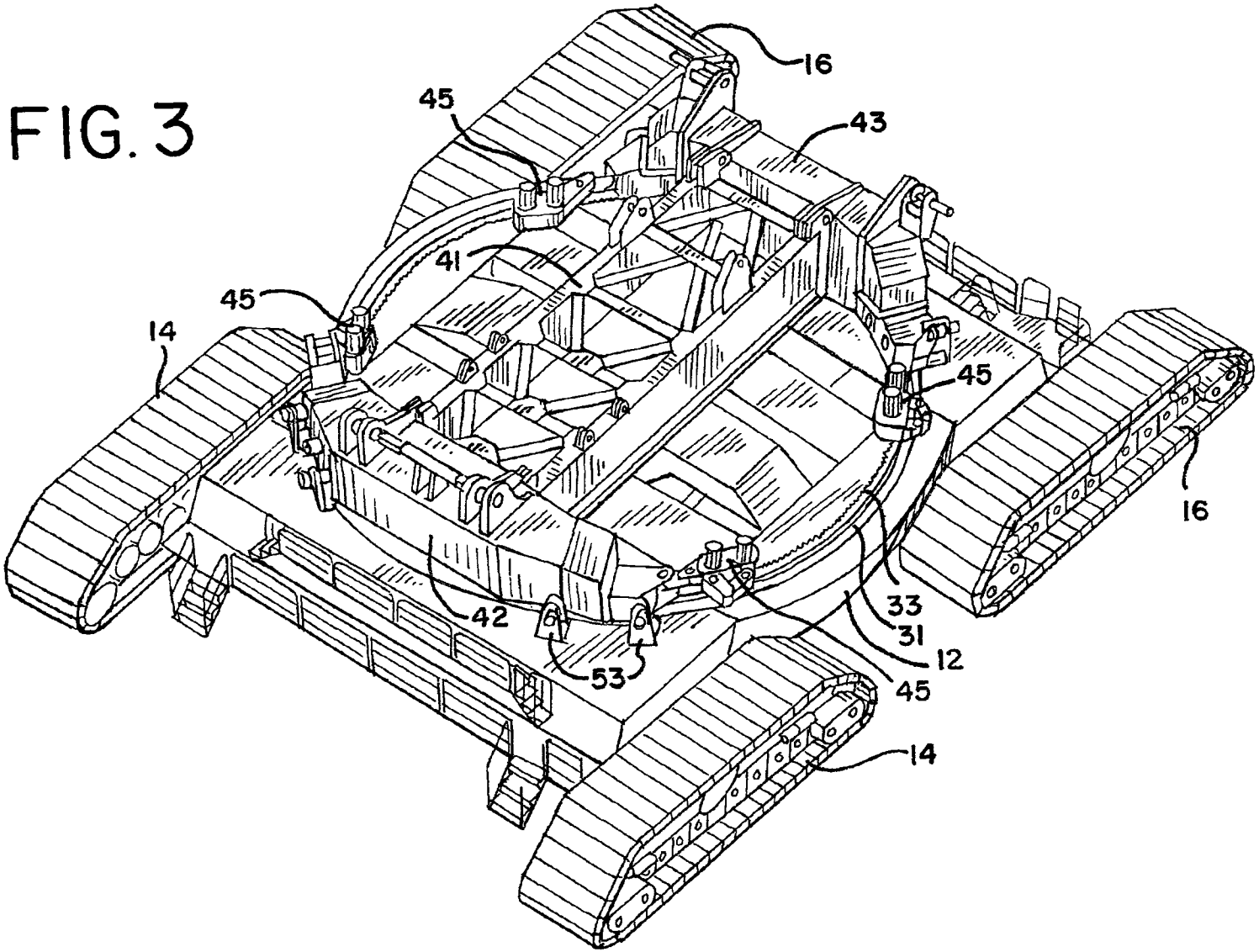
FIG. 3 is a perspective view of the carbody and crawlers of the crane of FIG. 1 with front and rear roller carriers installed.
Figures 12, 13:
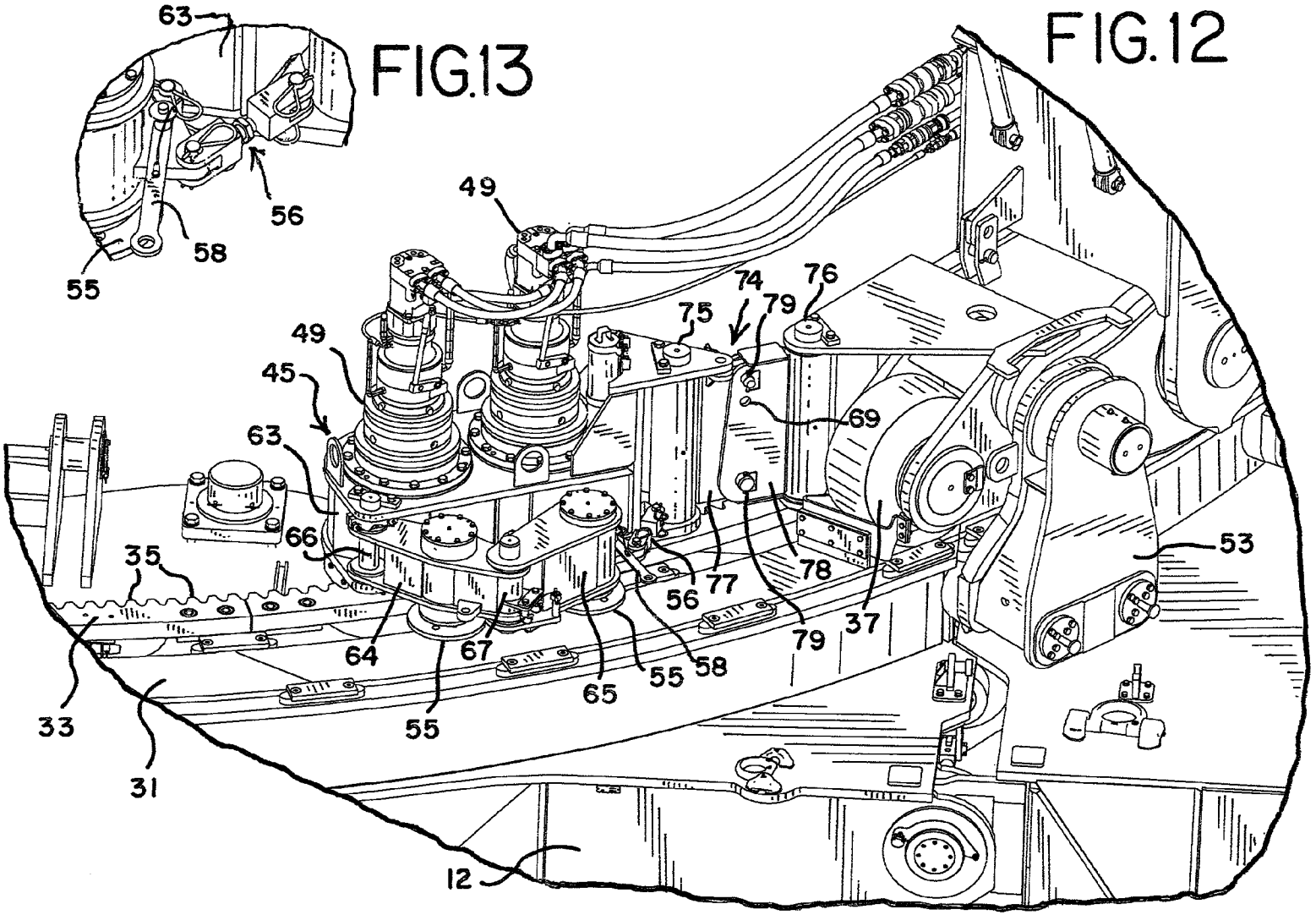
FIG. 12 is an enlarged perspective view of one of the drive assembles and the associated end of the roller carrier in place on a ring gear and roller path in the crane of FIG. 1.
FIG. 13 is an enlarged perspective view of one of the turnbuckles on the drive assembly in the crane of FIG. 1.

As best seen in FIG. 3, the lower portion of the rotating bed 20 of the crane 10 is made up of three major assembles, a rotating bed center frame 41, a front roller carrier 42 and a rear roller carrier 43. Also shown in FIG. 3 are the roller path 31 and the ring gear 33 which are part of the carbody 12. The teeth 35 (FIG. 4) on the ring gear 33 depicted in the drawings are on an inside surface of the ring gear. As described in U.S. patent application Ser. No. 12/561,103, the carbody may be constructed from separate pieces, and the roller path 31 and ring gear 33 are preferably made of segments that are bolted onto and transported with the carbody sections. The complete roller path 31 and ring gear 33 are then created as the sections of the carbody 12 are assembled at a job site. Of course the present invention is applicable to cranes with ring gears made in a convention fashion. The roller carriers ride on rollers 37 (FIG. 5) on the ring path, and stay connected to the carbody though conventional hook and roller assemblies 53, as best seen in FIG. 12.

Figure 4:
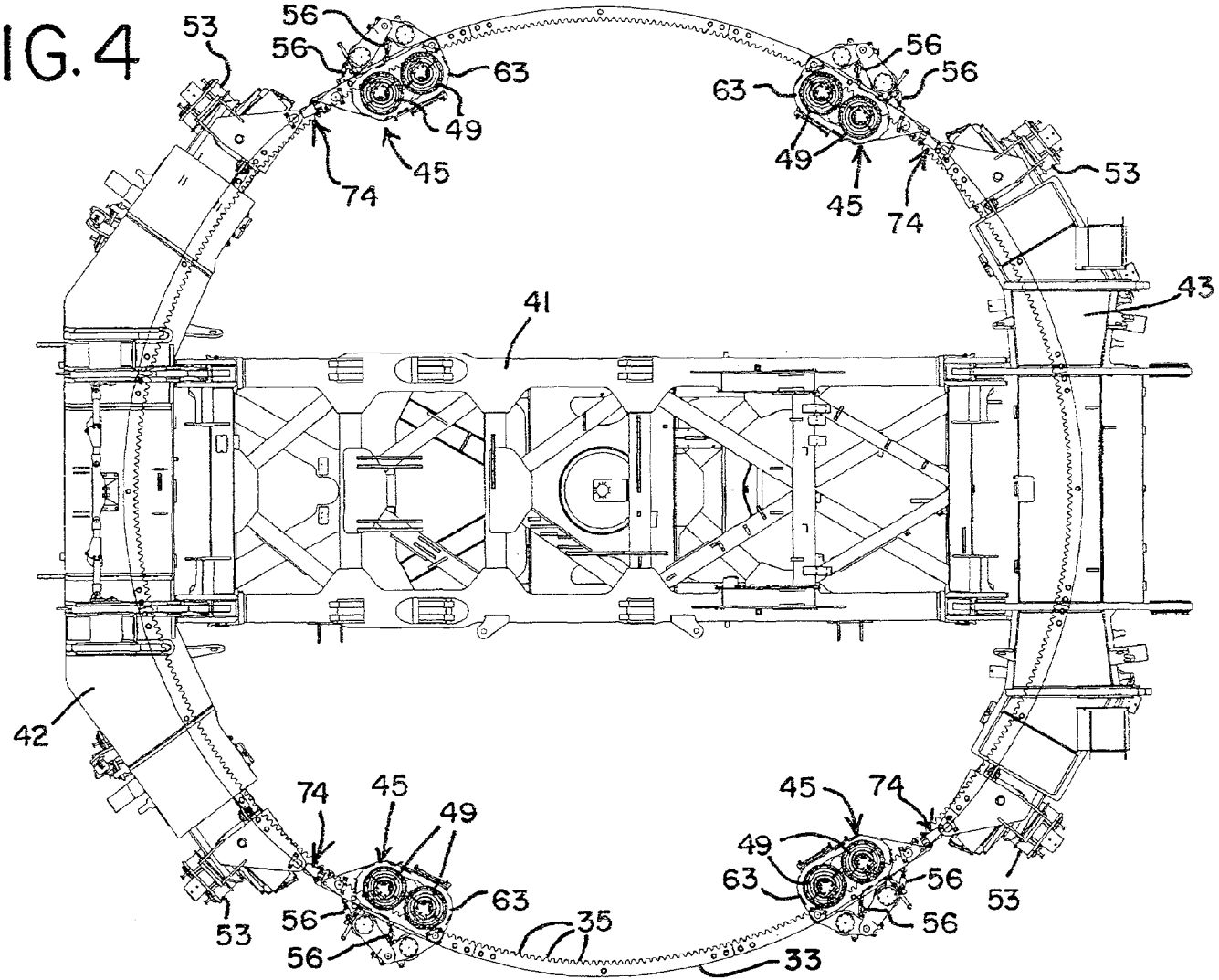
FIG. 4 is a top plan view of the ring gear, rotating bed center frame, roller carriers and drive system of the crane of FIG. 1, with other crane components removed for sake of clarity.
Figure 5:
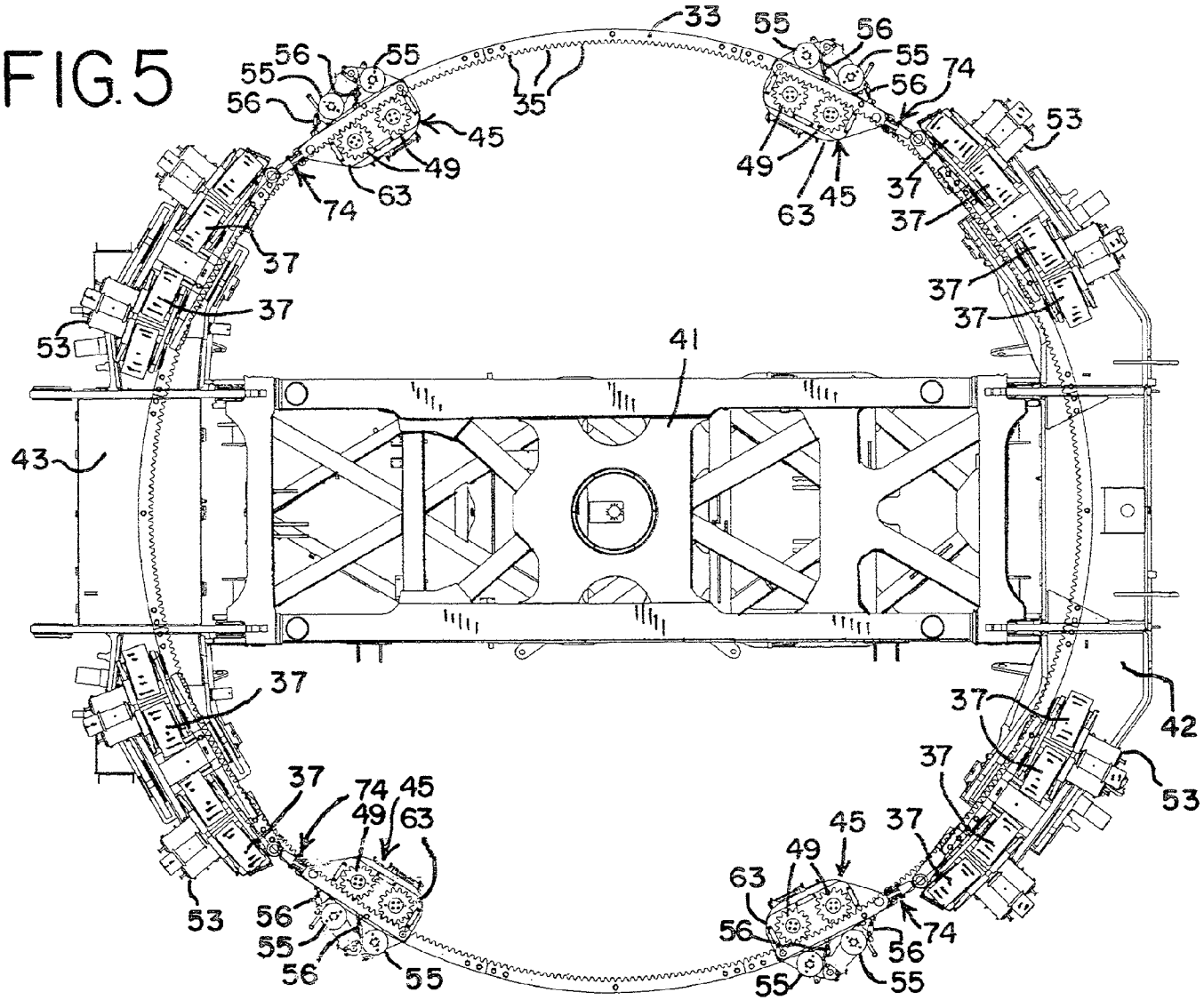
FIG. 5 is a bottom plan view of the ring gear, rotating bed center frame, roller carriers and drive system of the crane of FIG. 1, with other crane components removed for sake of clarity.
Figure 6:
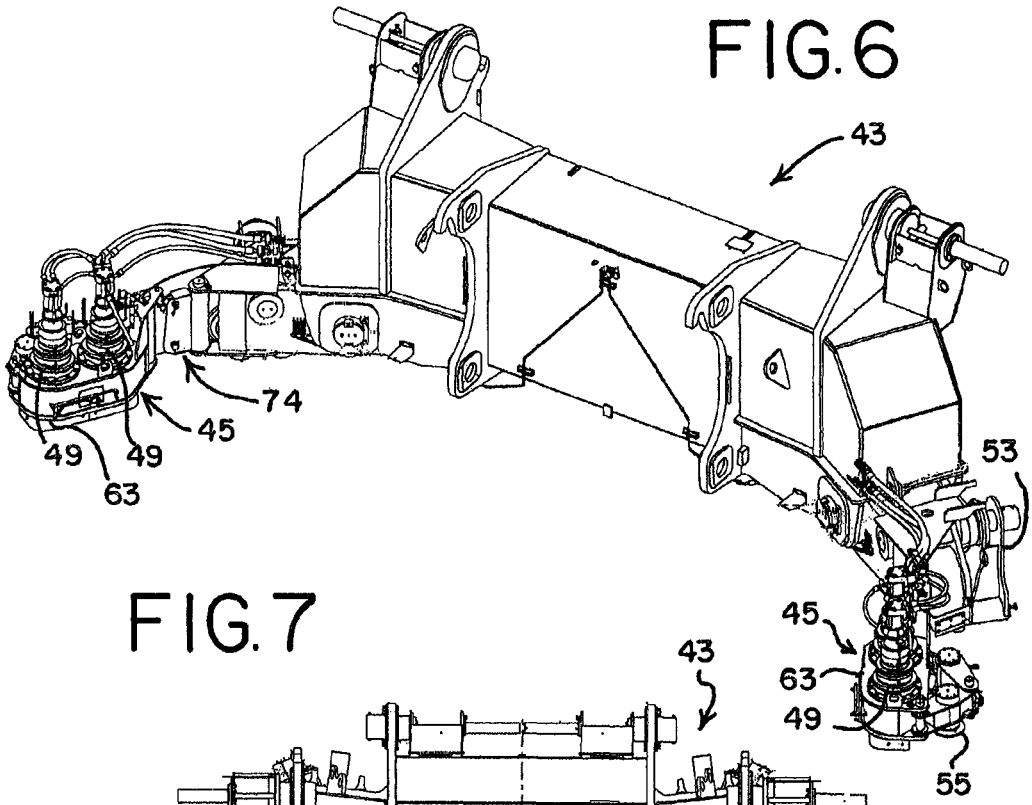
FIG. 6 is a perspective view of the rear roller carrier and associated swing drive system components of the crane of FIG. 1.
Figure 7:
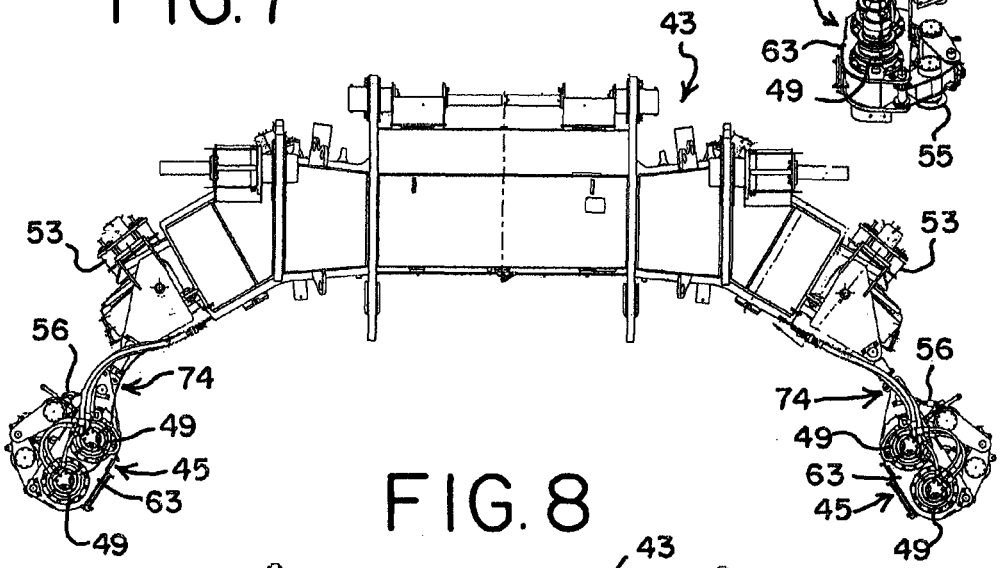
FIG. 7 is a top plan view of the rear roller carrier and associated swing drive system components of FIG. 6.
Figure 8:
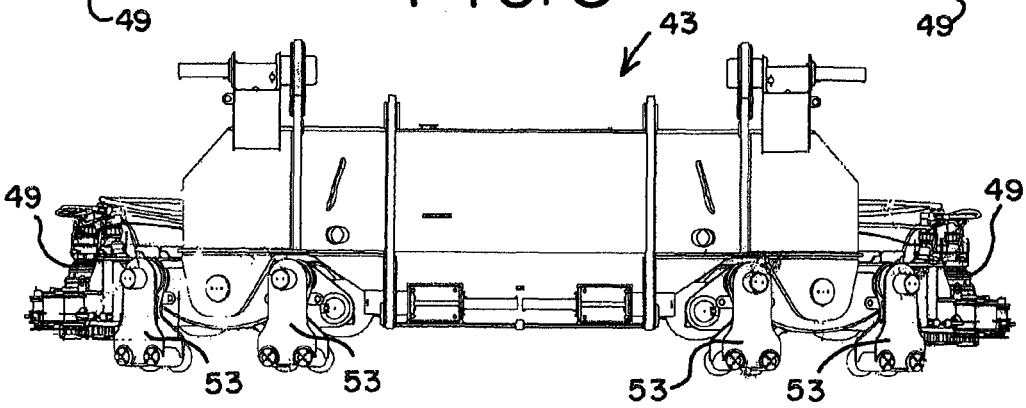
FIG. 8 is a rear elevation view of the rear roller carrier and associated swing drive system components of FIG. 6.
Figure 9:
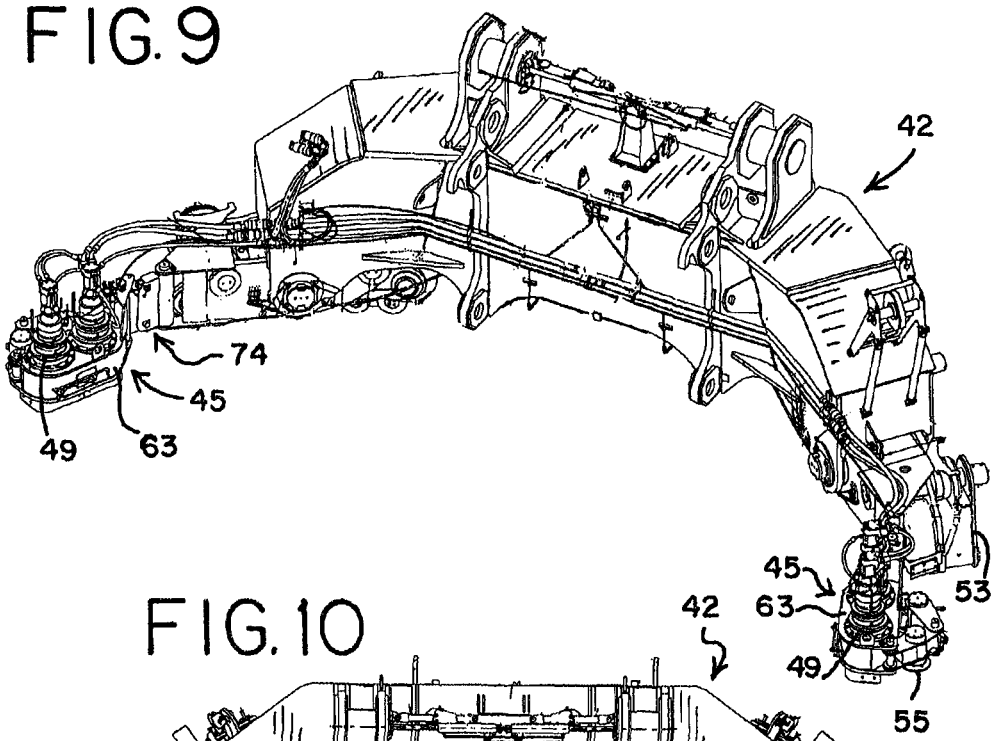
FIG. 9 is a perspective view of the front roller carrier and associated swing drive system components of the crane of FIG. 1.
Figure 10:
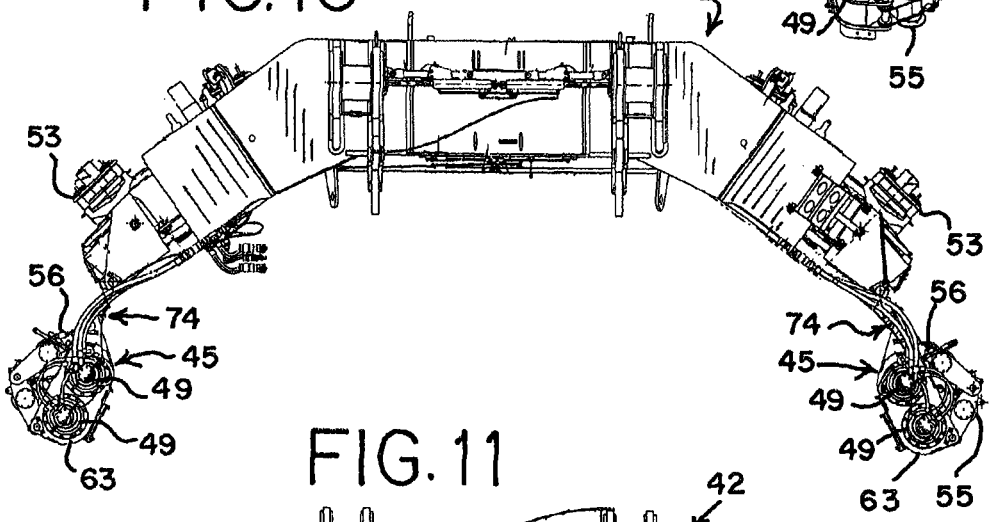
FIG. 10 is a top plan view of the front roller carrier and associated swing drive system components of FIG. 9.
Figure 11:
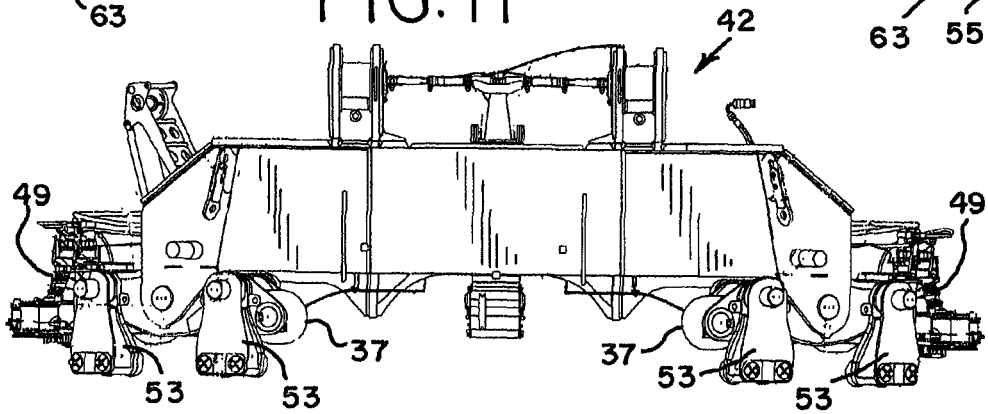
FIG. 11 is a front elevation view of the front roller carrier and associated swing drive system components of FIG. 9.

The crane 10 uses a plurality of pinion gears in driving contact with the ring gear teeth 35. In the embodiment shown in the drawings, there are eight pinion gears in the swing drive system, each with an associated hydraulic drive motor and gearbox. For sake of simplicity, and since the hydraulic motor, gearbox and pinion gear combinations are conventional in their design, and always connected together when used in the invention, this combination will be referred to as a pinion gear drive. The eight pinion gear drives are arranged as four independent swing drive assemblies 45, each containing a pair of pinion gear drives 49, as seen in FIGS. 4 and 5. Each swing drive assembly 45 is attached to one of the lateral ends of each of the front and rear roller carriers 42 and 43. Each pair of pinion gear drives in the swing drive assembly 45 is mounted in a common frame 63. The portion of the frame that holds the two pinion gear drives is rigid, meaning that the pinion gear drives are held by the frame in a fixed position relative to one another. The frame 63 also includes at least one, and preferably two guide rollers 55 mounted to the same frame, engaging the ring gear 33 on a surface opposite the surface having teeth 35 thereon. The guide rollers thus function to hold the pinion gears into mesh with a large diameter internal tooth ring gear 33.

The frame 63 includes an adjustment structure that allows adjustment of the distance between the pinion gears and the at least one guide roller 55. Where the drive assembly 45 includes two guide rollers 55, two adjustment structures that allow independent adjustment of the distances between the pinion gears and the two guide rollers of each assembly are used. The guide rollers 55 are mounted on a member (made of first and second roller holders) that includes a hinge pin between the two guide rollers and is connected to the remainder of the frame 63 by a second hinge pin. As best seen in FIG. 12, the frame 63 includes first and second roller holders 64 and 65 and first and second hinge pins 66 and 67. Hinge pin 66 connects first roller holder 64 to the main portion of the frame 63. Hinge pin 67 connects the second roller holder 65 to the first roller holder 64.

Preferably the distances between the guide rollers and the pinion gears are adjusted by means of a pair of turnbuckles, best seen in FIGS. 4 and 5. One of the turnbuckles 56 can be seen in detail in FIGS. 12 and 13. Adjustment of the turnbuckles control the pinion/ring gear backlash. The first turnbuckle acts to adjust the distance of the first roller holder 64 to the rest of the frame. Both turnbuckles act to adjust the distance of the second roller holder 65 to the rest of the frame 63, but this distance can be independently adjusted by action of the second turnbuckle at the far end of second roller holder 65.

A pivoting link 74 connects the frame 63 to the rest of the crane structure with two pivot axes between the frame and the crane structure. The pivoting link in particular allows the drive assembly 45 to operate more smoothly. The link 74 comprises a plate structure connected on each end to one of two pivot pins 75 and 76, and the pivot axes are provided by a first pivotal connection between the frame 63 and pivot pin 75, and the second pivotal connection is provided between the second pivot pin 76 and the roller carrier main frame. As best seen in FIG. 12, the plate structure comprises two sets of plates 77 and 78 pinned together with pins 79. The pins 79 allow the plates 77 and 78 to be reconfigured so that the frame 63 can be moved to a storage position. The top pin 79 can be removed and the frame 63 raised so that plate 77 pivots about lower pin 79. The upper pin is then reinserted through a second hole 69 in plate 78 that aligns with a hole (not seen) in plate 77. In this position the turnbuckle 56 can be disconnected from the main part of frame 63, and the guide rollers 55 may swing past the ring gear 33. In this storage mode, the turnbuckle 56 and the roller holders 64 and 65 pivot around pin 66 so that rollers 55 are to the side of the pinion gear drives 49. Retainer 58 shown in FIGS. 12 and 13 is connected to the end of the turnbuckle that was disconnected from the main portion of frame 63 to hold the turnbuckle 56 in a stable position for transport. The entire frame 63 and link 74 can then pivot around pin 76 so that the drive system swings in close to the roller carrier. If the weight of the roller carriers 42 or 43 needs to be reduced for transport, the drive system can be completely removed by pulling pins 79.

As the pinion gears are driven by the gearboxes, the gear set produces an inward radial force that attempts to pull the pinion gear out of mesh with the ring gear 33. The guide rollers 55, mounted to the primary frame 63, are designed to hold the pinion gear into mesh by riding along the outer diameter of the ring gear 33. By shortening and lengthening the adjustment turnbuckles 56, the backlash can be controlled. The use of the pivoting link 74 adds a degree of freedom to this system that allows the swing drive assembly to "float" on the ring gear 33. The pivoting link 74 transfers all of the tangential swing drive force to the roller carriers. Disregarding the vertical forces (gravity and lead tolerance), the pinion gears and guide rollers run independent of the main mounting structure. Because of this, motion of the supporting structure has virtually no effect on the gear mesh and therefore the true position of the pivot kingpin on the supporting structure is far less critical than in previous systems. This allows the pin hole tolerances to be wider and the clearance in the kingpin bearings and related components to be able to increase as well, potentially reducing overall costs.

There are some effects that the motion of the supporting structure (in this case the roller carrier to which the drive system is attached) has on the swing drive system which should be taken into account when designing the individual components used in the swing drive assembly and link of the present invention. First, radial motion of the supporting structure causes the pivoting link to deviate from its neutral position. This creates an imbalance in the compressive loads seen by the guide rollers 55. Depending on the direction the pivoting link deviates in, the load on one guide roller will increase while the other will decrease. Care must be taken during design to ensure that the guide roller loads will never be reduced to near zero values. If this happens, the drive pinion corresponding to that guide roller will tend to run without backlash, resulting in galling and rapid wearing of the teeth. The amount of deviation that causes this reduction in guide roller loading will be the absolute maximum allowable deviation that a designer will take into account in designing the pivoting link.

Figure 14:
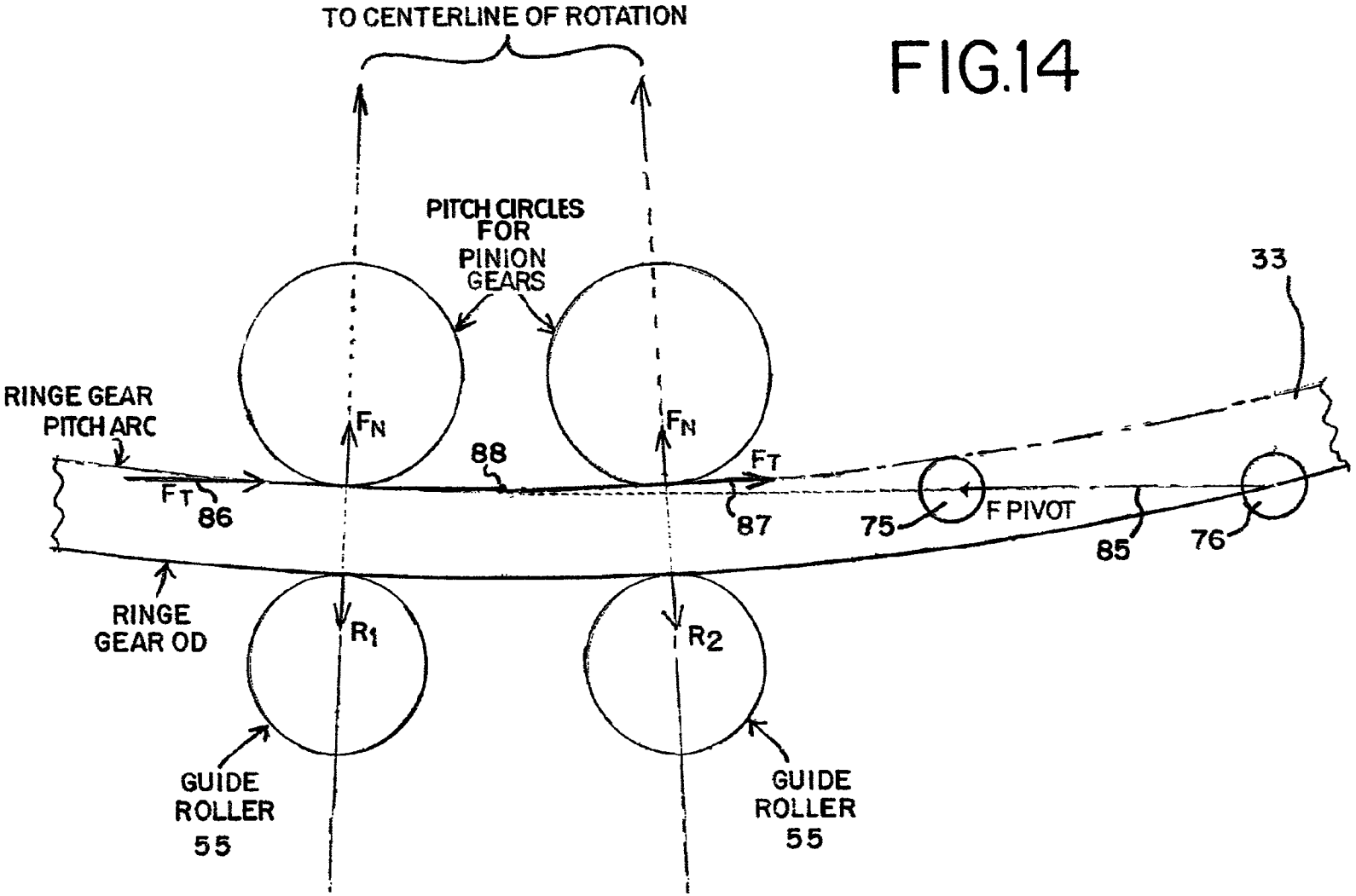
FIG. 14 is a schematic illustration of the pinion gears, guide rollers and pivoting connection link, shown with respect to the portion of the ring gear to which it is engaged, of one of the drive assemblies of the swing drive system used on the crane of FIG. 1.

There are two design considerations that will not only simplify the analysis of the design, but decrease the loads applied to the system components, and are therefore used in the preferred embodiment of the invention. These are best understood in view of a schematic drawing (FIG. 14) in which the forces acting on the various components of the drive system are represented. FIG. 14 illustrates the arrangement of the pinion gears, guide rollers and pivoting connection link, shown with respect to the portion of the ring gear to which it is engaged. The pinion gears are represented in FIG. 14 by their pitch circles, which are the circles at which the drive teeth can be considered to engage and transmit force. Likewise, the ring gear is represented on one surface by the ring gear pitch circle, or ring gear pitch arc since only a portion of the ring gear is depicted. The outside circumference of the ring gear and the guide rollers are depicted, since this is where the forces on those members are transmitted.

The first design consideration is that each guide roller 55 is preferably aligned radially with its respective drive pinion. In other words, each guide roller is aligned on a radius of the swing gear with one of the pinion gears, as seen in FIG. 14. This causes the normal forces in the gear mesh (FN) to be balanced by the radial forces exerted by the guide rollers (R1 and R2) without exerting a moment on the swing drive assembly.

The second design consideration is to locate the neutral position of the pivoting link 74 so that its line of action falls on the intersection of the tangential forces from the gear meshes. Because they are both mounted vertically, the two pivot axes both lie in the same vertical plane, depicted by line 85 in FIG. 14, and that plane intersects at point 88 with the intersection of the lines 86 and 87, representing the tangential forces (FT) from the gear meshes of the pinion gears and the ring teeth. Because the pinion gears operate on a circular path, the driving loads of each gear mesh are directed in different directions and would create a moment if the pivoting link is not set properly. Analysis of the loads will still be necessary when the deviation of the pivot link is considered, but this will simplify the initial design layout.

When the crane 10 is set up, and the swing drive system is installed, the backlash setup and adjustment procedure is as follows: 1) With the swing assembly attached to the machine, tighten both turnbuckles 56 until the pinion gears are brought into tight mesh with the ring gear 33. 2) Loosen the turnbuckle closest to the supporting structure a half turn. 3) Loosen the turnbuckle furthest from the supporting structure until the specified backlash is reached. 4) Loosen the turnbuckle closest to the supporting structure until the specified backlash is reached. 5) After all backlash adjustments have been made, swing the machine slowly through 360 degrees of motion to ensure the backlash is sufficient. The specified backlash will vary with each configuration of the drive system and ring gear (particularly the pinion gear diameter and the diametrial pitch of the teeth), as well as other aspects of the crane. However, the proper backlash can be determined by a person of ordinary skill in the art in consultation with a standard gear design handbook. In the embodiment depicted in the attached drawings, with a pinion gear having a pitch diameter of about 15 inches and a 1 diametrial pitch tooth size, it was determined that a gap of 0.06 inches between the guide roller and the outside circumference of the ring gear, producing a 0.061 inch backlash in the gear set, was appropriate.

Using two pinion drive gears in one common frame cuts in half the number of components that have to be independently disconnected, transported and reconnected to utilize the same number of pinion gears in a swing drive system compared to having each pinion gear independently installed. In addition to the advantages discussed above, the present invention allows the use of lower torque motors for the pinion gears than would be required if fewer pinion gears were used. For very large cranes, this reduces the cost because lower torque motor and gear box combinations are less than half the price for a motor and gear box than can generate twice the torque. Also, the design results in a drive system with a longer life expectancy.

It should be understood that various changes and modifications to the presently preferred embodiments described herein will be apparent to those skilled in the art. For example, instead of the pinion gears being held in place against the ring gear by one or two guide rollers, some other structure could be used, such as a structure that generated a force from behind the pinion gears compared to the ring gear. While the system has been shown with the ring gear mounted on the carbody, the ring gear could be mounted on the rotating bed, and the pinion gears could be mounted on the carbody. Also, while the ring gear has been shown with teeth on the surface of its inside diameter, the teeth could be placed on the outside diameter of the ring gear. Such changes and modifications can be made without departing from the spirit and scope of the present invention and without diminishing its intended advantages. It is therefore intended that such changes and modifications be covered by the appended claims.

The invention claimed is:

1. A crane comprising i) a lower structure comprising ground engaging members; ii) an upper structure rotatably connected to the lower structure such that the upper structure can swing with respect to the lower structure, wherein one of the lower structure and upper structure comprises a first structure having a ring gear having teeth on a surface thereof, and the other of the lower structure and upper structure comprises a second structure; and iii) a boom pivotally mounted on the upper structure, the crane including a swing drive system comprising:

a) at least two pinion gears mounted on a common frame so that the pinion gears are held by the frame in a fixed position relative to one another, and in driving contact so that they mesh with the ring gear teeth; and b) a link connecting the frame to the second structure with two pivot axes between the frame and the second structure.

2. The crane of claim 1 further comprising at least one guide roller mounted to the frame and engaging the ring gear on a surface opposite the surface having teeth thereon.

3. The crane of claim 2 further comprising an adjustment structure that allows adjustment of the distance between the at least two pinion gears and the at least one guide roller.

4. The crane of claim 3 wherein the adjustment structure comprises a turnbuckle.

5. The crane of claim 1 further comprising two guide rollers mounted to the frame and engaging the ring gear on a surface opposite the surface having teeth thereon.

6. The crane of claim 5 further comprising two adjustment structures that allow independent adjustment of i) the distance between a first one of the pinion gears and a first one of the guide rollers and ii) the distance between a second one of the pinion gears and a second one of the guide rollers.

7. The crane of claim 5 wherein each guide roller is aligned on a radius of the ring gear with one of the pinion gears.

8. The crane of claim 1 further comprising at least two motors, each of which is connected to one of said at least two pinion gears by a gear box.

9. The crane of claim 1 wherein the two pivot axes both lie in the same plane, and that plane intersects with the intersection of the lines of tangential forces from the gear meshes of the pinion gears and the ring gear teeth.

10. The crane of claim 1 wherein the teeth on the ring gear are on an inside surface of the ring gear.

11. The crane of claim 1 wherein the first structure having the ring gear thereon is the lower structure, and the at least two pinion gears are attached to the upper structure.

12. A mobile lift crane comprising:

a) a carbody having moveable ground engaging members;

b) a rotating bed rotatably connected to the carbody such that the rotating bed can swing with respect to the moveable ground engaging members;

c) a boom pivotally mounted on the rotating bed;

d) one of the carbody and rotating bed comprising a first structure and the other of the carbody and rotating bed comprising a second structure;

e) a ring gear having teeth on a surface thereof mounted on the first structure;

f) a plurality of pinion gears mounted on the second structure in driving engagement so that they mesh with the ring gear teeth;

g) at least two of the pinion gears being mounted on a common frame so that the pinion gears are held by the frame in a fixed position relative to one another; and h) a link connecting the frame to the second structure with two pivot axes between the frame and the second structure.

13. The mobile lift crane of claim 12 wherein the plurality of pinion gears comprise eight pinion gears arranged with two pinion gears each mounted on one of four independent frames, each frame being connected to the second structure with two pivot axes between the frame and the second structure.

14. The mobile lift crane of claim 12 further comprising two guide rollers mounted to the frame and engaging the ring gear on a surface opposite the surface having teeth thereon.

15. The mobile lift crane of claim 14 wherein each guide roller is aligned on a radius of the ring gear with one of the plurality of pinion gears.

16. The mobile lift crane of claim 14 wherein the guide rollers are mounted on a member that includes a hinge pin between the two guide rollers and is connected to the frame by a second hinge pin, and the frame further comprises an adjustment structure allowing the independent adjustment of i) the distance between a first one of the pinion gears and a first one of the guide rollers and ii) the distance between a second one of the pinion gears and a second one of the guide rollers.

17. The mobile lift crane of claim 16 wherein the adjustment structure comprises two turnbuckles.

18. The mobile lift crane of claim 12 wherein the link comprises a plate structure connected on each end to one of a first and a second pivot pin, and the pivot axes are provided by i) a first pivotal connection between the frame and the first pivot pin and ii) a second pivotal connection between the second pivot pin and the second structure.

19. The mobile lift crane of claim 18 wherein the plate structure comprises two sets of plates pinned together with locking pins, such that removal of the locking pins allows the frame, pinion gears and first pivot pin to be disconnected from the second structure.

20. The crane of claim 12 wherein the ring gear is mounted on the carbody and the pinion gears are attached to the rotating bed.

21. The mobile lift crane of claim 20 wherein the rotating bed comprises front and rear roller carriers, and two independent frames with two pinion gears each are mounted on the front roller carrier, and two independent frames with two pinion gears each are mounted on the rear roller carrier.

22. The mobile lift crane of claim 12 wherein the two pivot axes both lie in the same plane, and that plane intersects with the intersection of the lines of tangential forces from the gear meshes of the pinion gears and the ring gear teeth.

* * * * *

UNITED STATES PATENT AND TRADEMARK OFFICE

CERTIFICATE OF CORRECTION

PATENT NO. : 8,573,419 B2
APPLICATION NO. : 12/710960
DATED : November 5, 2013
INVENTOR(S) : Kaiser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 600 days.

Signed and Sealed this
Twelfth Day of May, 2015

Michelle K. Lee

Michelle K. Lee
*Director of the United States Patent and Trademark Office*